US011160386B2

(12) United States Patent
Jansen et al.

(10) Patent No.: US 11,160,386 B2
(45) Date of Patent: Nov. 2, 2021

(54) BODY SUPPORT CUSHION WITH VENTILATION SYSTEM

(71) Applicant: Tempur World, LLC, Lexington, KY (US)

(72) Inventors: Taylor M. Jansen, Trinity, NC (US); Hamid Ghanei, Trinity, NC (US); James A. Evans, Jr., Trinity, NC (US); Justin Alberto, Trinity, NC (US); Judson P. Gwaltney, Trinity, NC (US); Stephen Switzer, Trinity, NC (US); Henry Garma, Trinity, NC (US); Alanda Tar, Trinity, NC (US)

(73) Assignee: TEMPUR WORLD, LLC, Lexington, KY (US)

( * ) Notice: Subject to any disclaimer, the term of this patent is extended or adjusted under 35 U.S.C. 154(b) by 458 days.

(21) Appl. No.: 16/023,364

(22) Filed: Jun. 29, 2018

(65) Prior Publication Data

US 2020/0000241 A1 Jan. 2, 2020

(51) Int. Cl.

| | |
|---|---|
| ***A47C 21/04*** | (2006.01) |
| ***A47C 27/15*** | (2006.01) |
| ***A47C 31/00*** | (2006.01) |
| ***A47C 17/04*** | (2006.01) |

(52) U.S. Cl.

CPC ..... *A47C 21/044* (2013.01); *A47C 17/04* (2013.01); *A47C 27/15* (2013.01); *A47C 31/001* (2013.01); *A47C 31/005* (2013.01)

(58) Field of Classification Search

CPC ..... A47C 21/04; A47C 21/042; A47C 21/044; A47C 21/048; A47C 31/005; A47C 27/15; A47C 7/74; A47C 7/742; A47C 7/744; A61G 7/05792

See application file for complete search history.

(56) References Cited

U.S. PATENT DOCUMENTS

| | | | |
|---|---|---|---|
| 1,142,876 | A | 6/1915 | Davis et al. |
| 2,462,984 | A | 3/1949 | Maddison |
| 3,101,488 | A | 8/1963 | Peebles |
| 3,266,064 | A | 8/1966 | Figman |
| 3,529,310 | A | 9/1970 | Olmo |
| 4,467,611 | A | 8/1984 | Nelson et al. |
| 4,580,301 | A | 4/1986 | Ludman et al. |

(Continued)

FOREIGN PATENT DOCUMENTS

| | | | |
|---|---|---|---|
| CA | 2428225 | A1 | 5/2002 |
| EP | 113149 | B1 | 4/1987 |

(Continued)

OTHER PUBLICATIONS

US 9,398,814 B2, 07/2016, Richards et al. (withdrawn)

(Continued)

*Primary Examiner* — Eric J Kurilla
*Assistant Examiner* — Amanda L Bailey
(74) *Attorney, Agent, or Firm* — Stites & Harbison, PLLC; Terry L. Wright

(57) ABSTRACT

A body support cushion is provided with layered foam which receives airflow and allows passage in predefined areas through the body support cushion. Additionally, a cover is provided including a spacer fabric that allows air movement from the body support cushion to improve ventilation of the user of the cushion.

18 Claims, 10 Drawing Sheets

(56) References Cited

U.S. PATENT DOCUMENTS 4,644,753 A 2/1987 Burke
4,922,721 A 5/1990 Robertson et al.
4,939,804 A 7/1990 Grant
5,136,850 A 8/1992 Bierschenk et al.
5,171,272 A 12/1992 Recine, Sr.
5,249,826 A 10/1993 Bell
5,295,709 A 3/1994 Bell
5,315,830 A 5/1994 Doke et al.
5,367,879 A 11/1994 Doke et al.
5,367,890 A 11/1994 Doke
5,398,510 A 3/1995 Gilley et al.
5,448,788 A 9/1995 Wu
5,487,002 A 1/1996 Diller et al.
5,501,076 A 3/1996 Sharp, III et al.
5,505,046 A 4/1996 Nelson et al.
5,518,271 A 5/1996 Bell
5,522,216 A 6/1996 Park et al.
5,524,439 A 6/1996 Gallup et al.
5,546,618 A 8/1996 Beedy et al.
5,576,512 A 11/1996 Doke
5,597,200 A 1/1997 Gregory et al.
5,626,021 A 5/1997 Karunasiri et al.
5,650,904 A 7/1997 Gilley et al.
5,703,464 A 12/1997 Karunasiri et al.
5,737,923 A 4/1998 Gilley et al.
5,860,280 A 1/1999 Recine, Sr. et al.
5,887,304 A * 3/1999 von der Heyde .... A47C 21/044 5/423
6,003,319 A 12/1999 Gilley et al.
6,069,581 A 5/2000 Bell et al.
6,119,463 A 9/2000 Bell
6,169,245 B1 1/2001 Sharp
6,188,011 B1 2/2001 Nolas et al.
6,207,888 B1 3/2001 Nolas
6,223,539 B1 5/2001 Bell
6,232,910 B1 5/2001 Bell et al.
6,253,401 B1 7/2001 Boyd
6,269,314 B1 7/2001 Iitawaki et al.
6,336,237 B1 1/2002 Schmid
6,358,608 B1 3/2002 Hanyon et al.
6,360,390 B1 3/2002 Bonaddio
6,372,812 B1 4/2002 Niederoest et al.
6,380,883 B1 4/2002 Bell et al.
6,399,871 B1 6/2002 Sharp
6,400,308 B1 6/2002 Bell et al.
6,425,527 B1 7/2002 Smole
6,492,585 B1 12/2002 Zamboni et al.
6,546,576 B1 4/2003 Lin
RE38,138 E 6/2003 Gallup et al.
6,606,866 B2 8/2003 Bell
6,660,925 B1 12/2003 Sharp
6,700,052 B2 3/2004 Bell
6,716,890 B1 4/2004 Niederoest et al.
6,734,220 B2 5/2004 Niederoest et al.
6,740,687 B2 5/2004 Niederoest et al.
6,756,416 B2 6/2004 Thompson et al.
6,823,548 B2 11/2004 Murphy et al.
6,841,586 B2 1/2005 Free et al.
7,005,458 B2 2/2006 Lovette
7,114,771 B2 10/2006 Lofy et al.
7,150,059 B2 12/2006 Small, Jr. et al.
7,165,281 B2 1/2007 Larsson et al.
7,178,344 B2 2/2007 Bell
7,240,386 B1 7/2007 McKay et al.
7,475,464 B2 1/2009 Lofy et al.
7,484,256 B2 2/2009 Murphy et al.
7,531,739 B1 5/2009 Moczygemba
7,587,901 B2 9/2009 Petrovski
7,589,037 B2 9/2009 Handermann et al.
7,591,507 B2 9/2009 Giffin et al.
7,619,158 B2 11/2009 Sharp et al.
7,640,754 B2 1/2010 Wolas
7,665,803 B2 2/2010 Wolas
7,687,139 B2 3/2010 Chan et al.
7,708,338 B2 5/2010 Wolas
7,763,792 B2 7/2010 Sharp et al.
RE41,765 E 9/2010 Gregory et al.
7,827,805 B2 11/2010 Comiskey et al.
7,849,542 B2 12/2010 DeFranks
7,858,542 B2 12/2010 Mio et al.
7,871,847 B2 1/2011 Moczygemba
7,877,827 B2 2/2011 Marquette et al.
7,886,388 B2 2/2011 Warren et al.
7,908,687 B2 3/2011 Ward et al.
7,913,332 B1 3/2011 Barnhart
D636,622 S 4/2011 Quinter et al.
7,963,594 B2 6/2011 Wolas
7,966,835 B2 6/2011 Petrovski
D642,413 S 8/2011 Rinehart
D642,845 S 8/2011 Farley
D642,847 S 8/2011 Rinehart
7,996,936 B2 8/2011 Marquette et al.
8,065,763 B2 * 11/2011 Brykalski ..... A47C 21/044 5/423
D652,715 S 1/2012 Quinter et al.
8,104,295 B2 1/2012 Lofy
8,143,554 B2 3/2012 Lofy
8,181,290 B2 5/2012 Brykalski et al.
8,191,187 B2 6/2012 Brykalski et al.
8,209,804 B2 7/2012 Apperson et al.
8,222,511 B2 7/2012 Lofy
8,247,466 B2 8/2012 Brown
D667,671 S 9/2012 Rinehart
8,256,236 B2 9/2012 Lofy
8,332,975 B2 12/2012 Brykalski et al.
8,353,069 B1 1/2013 Miller
8,359,689 B2 1/2013 Warren et al.
8,359,871 B2 1/2013 Woods et al.
8,402,579 B2 3/2013 Marquette et al.
8,418,286 B2 4/2013 Brykalski et al.
8,434,314 B2 5/2013 Comiskey et al.
8,438,863 B2 5/2013 Lofy
RE44,272 E 6/2013 Bell
8,621,694 B2 1/2014 Farley
8,703,631 B2 4/2014 Sytz
8,732,874 B2 5/2014 Brykalski et al.
8,745,784 B2 6/2014 Cole et al.
8,782,830 B2 7/2014 Brykalski et al.
8,856,993 B2 10/2014 Richards et al.
8,881,328 B2 11/2014 Mikkelsen et al.
8,893,329 B2 11/2014 Petrovski et al.
8,955,337 B2 2/2015 Parish et al.
9,044,365 B2 6/2015 Rawls-Meehan
9,044,366 B2 6/2015 Rawls-Meehan
9,066,497 B2 6/2015 Rawls-Meehan
D733,452 S 7/2015 Rawls-Meehan
D736,023 S 8/2015 Rawls-Meehan
9,125,497 B2 9/2015 Brykalski et al.
9,138,064 B2 9/2015 Tursi, Jr. et al.
9,173,793 B2 11/2015 Rawls-Meehan
9,173,794 B2 11/2015 Rawls-Meehan
9,265,352 B2 2/2016 Oakhill et al.
9,289,072 B2 3/2016 Albero et al.
9,307,843 B2 4/2016 Rawls-Meehan
D756,678 S 5/2016 Rawls-Meehan
D757,527 S 5/2016 Rawls-Meehan
9,392,875 B2 7/2016 Weyl
D763,005 S 8/2016 Rawls-Meehan
9,408,475 B2 8/2016 Mikkelsen et al.
9,433,546 B2 9/2016 Rawls-Meehan et al.
9,451,833 B2 9/2016 Rawls-Meehan
9,463,124 B2 10/2016 Lachenbruch et al.
9,474,384 B2 10/2016 Rawls-Meehan et al.
9,504,333 B2 11/2016 Rawls-Meehan et al.
9,510,690 B2 12/2016 Rawls-Meehan et al.
9,526,346 B2 12/2016 Rawls-Meehan
9,526,348 B2 12/2016 Richards et al.
9,526,665 B2 12/2016 Rawls-Meehan et al.
D778,639 S 2/2017 Rawls-Meehan et al.
9,578,975 B2 2/2017 Rawls-Meehan et al.
9,596,945 B2 3/2017 Ghanei et al.
9,603,459 B2 3/2017 Brykalski et al.
9,622,588 B2 4/2017 Brykalski et al.
9,629,473 B2 4/2017 Rawls-Meehan et al.

(56) References Cited

U.S. PATENT DOCUMENTS

| | | | | |
|---|---|---|---|---|
| D785,360 | S | 5/2017 | Rawls-Meehan | |
| 9,655,797 | B2 | 5/2017 | Rawls-Meehan et al. | |
| D793,786 | S | 8/2017 | Rawls-Meehan et al. | |
| D793,789 | S | 8/2017 | Rawls-Meehan | |
| 9,730,847 | B2 | 8/2017 | Lachenbruch et al. | |
| 9,955,791 | B2 | 5/2018 | Chandler et al. | |
| 2003/0019044 | A1 | 1/2003 | Larsson et al. | |
| 2004/0031103 | A1 | 2/2004 | Wyatt et al. | |
| 2004/0079407 | A1 | 4/2004 | Sharp | |
| 2004/0261830 | A1 | 12/2004 | Sharp et al. | |
| 2005/0086739 | A1 | 4/2005 | Wu | |
| 2006/0107989 | A1 | 5/2006 | Bierschenk et al. | |
| 2006/0124165 | A1 | 6/2006 | Bierschenk et al. | |
| 2006/0180192 | A1 | 8/2006 | Sharp et al. | |
| 2007/0056116 | A1 | 3/2007 | Galardo | |
| 2007/0107133 | A1 | 5/2007 | Schwaiger et al. | |
| 2007/0261548 | A1 | 11/2007 | Vrzalik et al. | |
| 2008/0028536 | A1 | 2/2008 | Hadden-Cook | |
| 2008/0047598 | A1 | 2/2008 | Lofy | |
| 2008/0084095 | A1 | 4/2008 | Wolas | |
| 2008/0100101 | A1 | 5/2008 | Wolas | |
| 2008/0148481 | A1* | 6/2008 | Brykalski ..... | A47C 21/048 5/423 |
| 2008/0173022 | A1 | 7/2008 | Petrovski | |
| 2008/0245397 | A1 | 10/2008 | Moczygemba et al. | |
| 2008/0263775 | A1 | 10/2008 | Clenet | |
| 2009/0064411 | A1 | 3/2009 | Marquette et al. | |
| 2009/0090409 | A1 | 4/2009 | Moczygemba | |
| 2009/0090544 | A1 | 4/2009 | Rawot et al. | |
| 2009/0093078 | A1 | 4/2009 | Moczygemba | |
| 2009/0193814 | A1 | 8/2009 | Lofy | |
| 2009/0211619 | A1 | 8/2009 | Sharp et al. | |
| 2009/0218855 | A1 | 9/2009 | Wolas | |
| 2010/0011502 | A1 | 1/2010 | Brykalski et al. | |
| 2010/0081191 | A1 | 4/2010 | Woods | |
| 2010/0146700 | A1 | 6/2010 | Wolas | |
| 2010/0019968 | A1 | 8/2010 | Woods et al. | |
| 2010/0193498 | A1 | 8/2010 | Walsh | |
| 2011/0035880 | A1 | 2/2011 | Cole et al. | |
| 2011/0048033 | A1 | 3/2011 | Comiskey et al. | |
| 2011/0107514 | A1 | 5/2011 | Brykalski et al. | |
| 2011/0119826 | A1 | 5/2011 | Marquette et al. | |
| 2011/0253340 | A1 | 10/2011 | Petrovski | |
| 2011/0258778 | A1 | 10/2011 | Brykalski et al. | |
| 2011/0271994 | A1 | 11/2011 | Gilley | |
| 2011/0289684 | A1 | 12/2011 | Parish et al. | |
| 2011/0296611 | A1 | 12/2011 | Marquette et al. | |
| 2011/0308020 | A1 | 12/2011 | Vrzalik et al. | |
| 2011/0314837 | A1 | 12/2011 | Parish et al. | |
| 2012/0000207 | A1 | 1/2012 | Parish et al. | |
| 2012/0017376 | A1* | 1/2012 | Mikkelsen ..... | A47C 27/144 5/726 |
| 2012/0080911 | A1 | 4/2012 | Brykalski et al. | |
| 2012/0110734 | A1 | 5/2012 | An | |
| 2012/0114512 | A1 | 5/2012 | Lofy et al. | |
| 2012/0131748 | A1 | 5/2012 | Brykalski et al. | |
| 2012/0227182 | A1 | 9/2012 | Brykalski et al. | |
| 2012/0261399 | A1 | 10/2012 | Lofy | |
| 2012/0305043 | A1 | 12/2012 | Kossakovski et al. | |
| 2012/0319439 | A1 | 12/2012 | Lofy | |
| 2013/0031722 | A1 | 2/2013 | Wong | |
| 2013/0032189 | A1 | 2/2013 | Moczygemba et al. | |
| 2013/0037073 | A1 | 2/2013 | LaGrandeur et al. | |
| 2013/0059190 | A1 | 3/2013 | Kossakovski et al. | |
| 2013/0067661 | A1 | 3/2013 | Schwirian et al. | |
| 2013/0086923 | A1 | 4/2013 | Petrovski et al. | |
| 2013/0097777 | A1 | 4/2013 | Marquette et al. | |
| 2013/0146116 | A1 | 6/2013 | Jovovic et al. | |
| 2013/0186448 | A1 | 7/2013 | Ranalli et al. | |
| 2014/0026320 | A1 | 1/2014 | Marquette et al. | |
| 2014/0033441 | A1 | 2/2014 | Morgan et al. | |
| 2014/0059780 | A1 | 3/2014 | Lafleche et al. | |
| 2014/0109314 | A1 | 4/2014 | Boersma et al. | |
| 2014/0189951 | A1 | 7/2014 | DeFranks et al. | |
| 2014/0250604 | A1 | 9/2014 | Lanning et al. | |
| 2014/0310881 | A1 | 10/2014 | Wyatt et al. | |
| 2015/0068609 | A1 | 3/2015 | Aramli | |
| 2015/0208814 | A1 | 7/2015 | Alletto et al. | |
| 2015/0208815 | A1 | 7/2015 | Chandler et al. | |
| 2015/0238020 | A1 | 8/2015 | Petrovski et al. | |
| 2015/0247656 | A1 | 9/2015 | Parish et al. | |
| 2015/0257540 | A1 | 9/2015 | Chandler | |
| 2015/0282631 | A1 | 10/2015 | Creamer | |
| 2015/0366365 | A1 | 12/2015 | Golin et al. | |
| 2016/0066701 | A1 | 3/2016 | Diller et al. | |
| 2016/0128487 | A1 | 5/2016 | Eskridge et al. | |
| 2016/0150891 | A1 | 6/2016 | Brykalski et al. | |
| 2016/0166073 | A1 | 6/2016 | Oakhill et al. | |
| 2016/0367037 | A1 | 12/2016 | Reynolds | |
| 2017/0020300 | A1 | 1/2017 | Murphy et al. | |
| 2017/0071359 | A1 | 3/2017 | Petrovski et al. | |
| 2017/0150823 | A1 | 6/2017 | Alletto et al. | |
| 2017/0202362 | A1 | 7/2017 | Reynolds | |
| 2018/0000255 | A1* | 1/2018 | Youngblood ..... | A47C 21/022 |
| 2018/0098637 | A1 | 4/2018 | Griese et al. | |
| 2018/0242753 | A1* | 8/2018 | Ghanei ..... | A47C 27/056 |
| 2020/0000242 | A1 | 1/2020 | Ermalovich et al. | |

FOREIGN PATENT DOCUMENTS

| | | | |
|---|---|---|---|
| EP | 1997467 | | 12/2008 |
| EP | 1804616 | B1 | 2/2012 |
| JP | 55-34463 | | 8/1953 |
| JP | 6022829 | | 2/1994 |
| JP | 07-313306 | | 12/1995 |
| JP | 2003-024184 | | 1/2003 |
| JP | 2006-014819 | | 1/2006 |
| MX | 2007002587 | A | 5/2007 |
| WO | 2005120295 | | 12/2005 |
| WO | 2009155595 | A3 | 12/2009 |
| WO | 2014105039 | A1 | 7/2014 |
| WO | 2015034528 | A1 | 3/2015 |
| WO | 2015199667 | A1 | 12/2015 |
| WO | 2016171692 | | 10/2016 |
| WO | 2016178057 | A1 | 11/2016 |
| WO | 2018083516 | A1 | 5/2018 |

OTHER PUBLICATIONS

Balluga, The World's Smartest Bed, Mar. 23, 2016 [retrieved from internet Aug. 10, 2017].

Tech Crunch, Wink Bed, Feb. 1, 2017 [retrieved from internet Aug. 10, 2017].

PCT/US2009/068814 International Search Report and Written Opinion dated Jun. 9, 2010.

Amerigon Incorporated, "Amerigon Reports 2008 Third Quarter, Nine-Month Results," press release, Oct. 28, 2008, pp. 4-10, PR Newswire, Yahoo Inc.

PCT/US2014/043993 International Search Report, 3 pgs, dated Mar. 24, 2015.

PCT/US2013/058681 International Preliminary Report on Patentability; 10 pgs, dated Mar. 15, 2016.

PCT/US2015/026086 Written Opinion and International Preliminary Report on Patentability; 19 pgs, dated Jul. 14, 2015.

PCT/US2019/039251 International Search Report and Written Opinon, 13 pages, dated Oct. 18, 2019.

The International Bureau of WIPO, International Preliminary Report on Patentability for PCT/US2019/039251 dated Dec. 29, 2020, 9 pages.

* cited by examiner

BODY SUPPORT CUSHION WITH VENTILATION SYSTEM

CROSS REFERENCE TO RELATED APPLICATION

None.

BACKGROUND

1. Field of the Invention

Present embodiments relate to a body support cushion with a ventilation system. More specifically, but without limitation, present embodiments relate to a body support cushion with a ventilation system in flow communication through the foam layers of a body support cushion.

2. Description of the Related Art

Research has shown that there seems to be an ideal temperature for sleep and when this temperature is very high, it takes longer to fall asleep, and once sleep is achieved, it may be broken up or fragmented. This problem is exacerbated during the summer months, causing people to lose much needed sleep which leads to poor performance the next day and potential health risks in the long term.

When temperature variations are prevented, research shows that people sleep better and feel more rested and revitalized the next day.

It would be desirable to offer to consumers who naturally sleep hot and whose sleep is continually disrupted by excessive heat storage in the mattress.

A need exists to provide a bed assembly with improved functionality of sleeping comfort. Therefore, it may be desirable to provide ventilation for a bed or other cushioned device.

The information included in this Background section of the specification, including any references cited herein and any description or discussion thereof, is included for technical reference purposes only and is not to be regarded subject matter by which the scope of the invention is to be bound.

SUMMARY

The present application discloses one or more of the features recited in the appended claims and/or the following features which alone or in any combination, may comprise patentable subject matter.

The present embodiments provide a mattress formed of foam which allows for ventilation air flow therethrough. The mattress may be formed of multiple foam layers and may receive air input through a lower surface thereof. The mattress provide a foam layer assembly which spreads the incoming air but bounds the air flow so the air moves upward through the upper layers and the holes in the upper surface thereof. The holes may be located in ventilation zones and the density of such holes may vary or may be consistent within the zone.

According to some embodiment a body support cushion with ventilation system comprises an adjustable foundation having at least a fixed base portion and a deck having at least a fixed deck portion, an air mover disposed on one of the fixed base portion or the fixed deck portion, the air mover having an inlet and an outlet, a conduit in flow communication with the air mover outlet at a first end of the conduit, a second end of said conduit in flow communication with a mattress. The mattress may have a lower support layer formed of convoluted foam, an air distribution assembly disposed above the lower support layer, the air distribution assembly including a cavity and an envelope material, a reticulated foam disposed in the cavity, a comfort layer disposed above said air distribution assembly and wherein the reticulated foam receives air from the conduit and distributes said air to a first plurality of apertures of the comfort layer and from the first plurality of apertures to an upper surface of a body support foam layer through a second plurality of apertures in the body support foam layer.

The following optional embodiments may be utilized alone with the previous embodiment or in combination with other embodiments and the previous embodiment. At least some of the first plurality of apertures are aligned with at least some of said second plurality of apertures. Further, at least one of the first or second plurality of apertures varying in density between head and foot ends of the mattress. The plurality of apertures may be substantially vertical or may be angled relative to a vertical direction. The cavity may be a first cavity and a second cavity. The body support cushion may further comprise an envelope material disposed above the cavity. The cavity may be rectangular. The cavity may have a conduit connection aperture. The cavity may define a boundary for air flow in the air distribution assembly. The mattress may be flexible and capable of moving with adjustment of the movable deck portion. The conduit may pass through the fixed deck portion. The air flow may be filtered and further provide aroma therapy. The body support cushion may further comprise a cover comprising a top panel and an inner panel having a spacer fabric. The spacer fabric may be disposed against the top panel. The spacer fabric being formed of a bi-directional stretch fabric having a three dimensional cross-structure. The body support cushion may further comprise a cartridge which provides aroma therapy in flow communication with the air mover. The body support cushion may further comprise a movable portion of the deck and wherein the foundation is adjustable.

According to some embodiments, a body support cushion with ventilation system may comprise a mattress having a lower support layer formed of convoluted foam and an air distribution assembly disposed above the lower support layer. The air distribution assembly may include a cavity and an envelope material disposed in the cavity. A reticulated foam may be disposed in the cavity on the envelope material. At least one foam layer may be disposed above the air distribution layer. The reticulated foam receives air from a conduit and through holes in the envelope material, and distributes the air to a plurality of apertures of the at least one foam layer.

According to some embodiments a cover for a ventilated body support cushion comprises a top panel having an upper layer ultra high molecular weight polyethylene and a lower layer fire resistant yarn knit to the upper layer, a border disposed beneath the top panel and having an inner panel, the inner panel including a bi-directionally stretched spacer fabric, the spacer fabric further comprising a three dimensional cross-structure, and, wherein the spacer fabric improves ventilation by reducing dry thermal resistance.

The following optional embodiments may be utilized alone with the previous embodiment or in combination with other embodiments and the previous embodiment. The cover may further comprise a fire resistant topical chemistry on the upper layer. The fire resistant yarn may be a modacrylic yarn. The cover may further comprise a fastener to attach the top panel to the border. The spacer fabric may have a first upper layer and a second lower layer and said three dimensional cross structure therebetween.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of a body support cushion with ventilation system will now be described by way of examples. These embodiments are not to limit the scope of the claims as other embodiments of a body support cushion with ventilation system will become apparent to one having ordinary skill in the art upon reading the instant description. Non-limiting examples of the present embodiments are shown in figures wherein:

DETAILED DESCRIPTION

Figure 1:
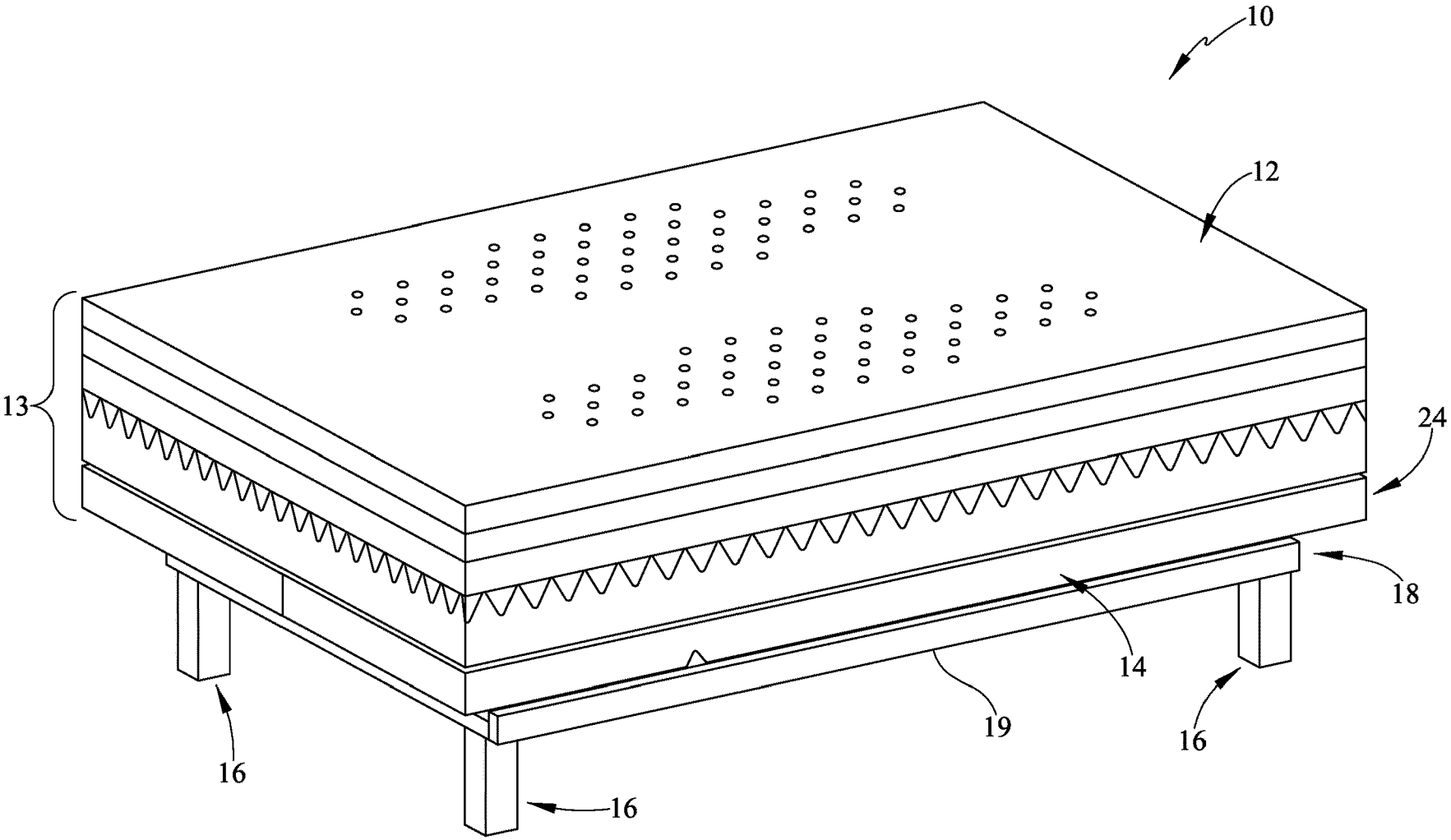
FIG. 1 is a perspective view of a bed assembly including mattress and foundation.
Figure 2:
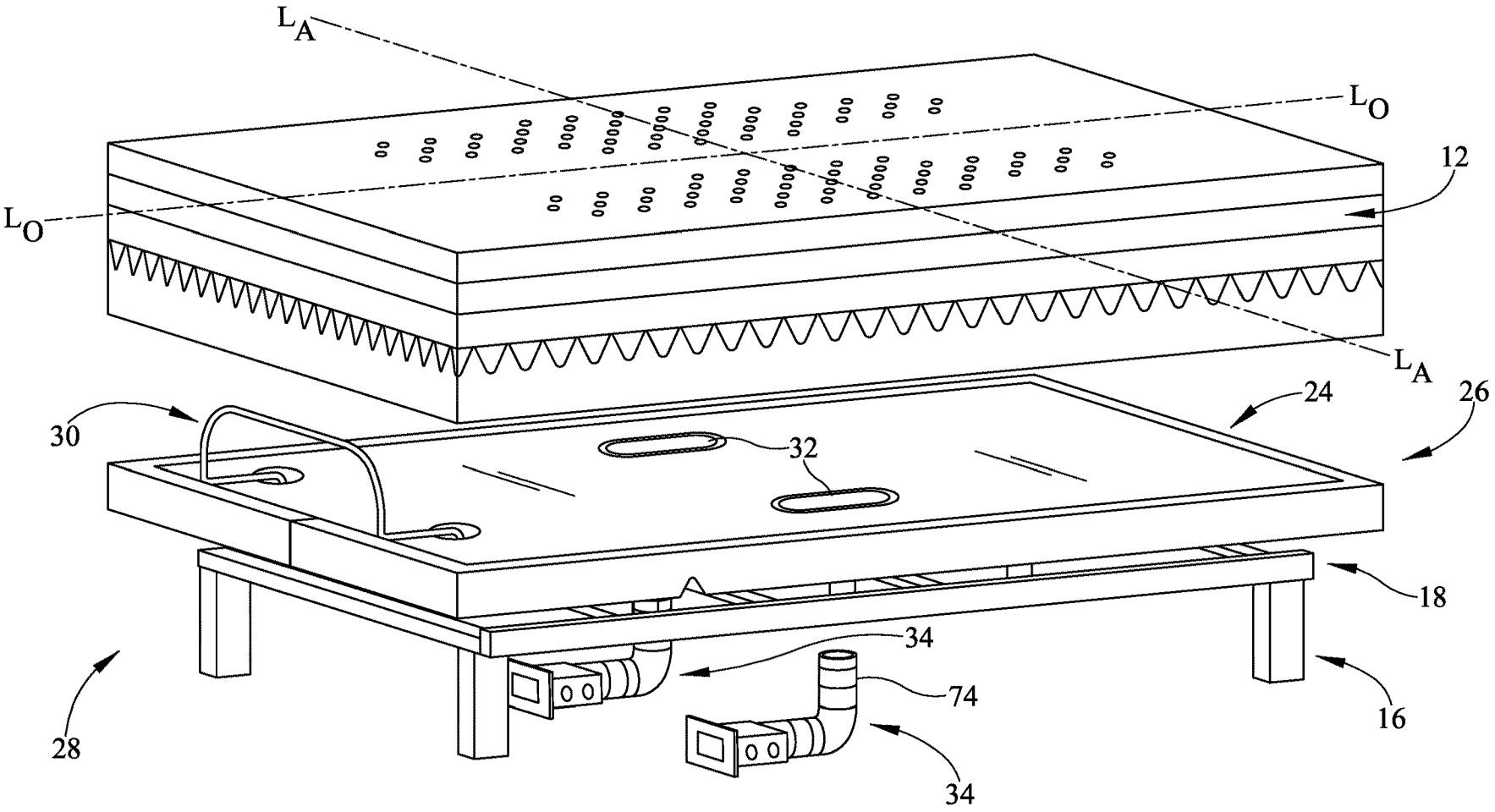
FIG. 2 is an exploded perspective view of the bed assembly.

It is to be understood that a body support cushion with ventilation system is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to FIGS. 1-10, the instant bed assembly provides ventilation through a body support cushion, such as for non-limiting example a mattress. This bed assembly uses active ventilation that prevents temperature fluctuations in bed and keeps the customer at a level body temperature throughout the night. It works by drawing in ambient air from the environment and pushing in through the mattress until it reaches the consumer's body unnoticed. During its trajectory, the air may be filtered and so the incoming air is free of bacteria, pollen and the secretions of house dust mites. By continuously flowing fresh air through the mattress, the surface temperature on the mattress and relative humidity in the micro-climate, remain constant throughout the night which means that there is no heat buildup and no undesired humidity. When temperature variations are prevented, research shows that people sleep better and feel more rested and revitalized the next day. Moreover, in some embodiments, the air may be conditioned (cooled or heated) to the ideal temperature based on the costumer's sleeping profile and by continuously directing a temperature-controlled air flow through the bed, the mattress retains freshness and stays optimally dry and hygienic.

Referring now to FIG. 1, a perspective view of a bed assembly 10 is depicted. The bed assembly 10 comprises a mattress 12 and a foundation 14. Although the mattress 12 is depicted throughout this embodiment, one skilled in the art should recognize that a mattress is merely one type of body support cushion and other body support cushion structures may be utilized within the scope of the instant disclosure. Thus, the scope of the claims should not be limited to a mattress but may include other structures as well.

The mattress 12 may be formed of foam layers in some embodiments. However, in other embodiments, the mattress 12 may also incorporate springs in combination with the foam. Further, the mattress 12 may also be one which is always in a horizontal position, as shown, or may also be formed to allow for a movable foundation.

The foundation 14 may be a fixed foundation such that the position of the bed assembly 10 position and the position of mattress 12 is not adjustable, or alternatively, the foundation 14 maybe adjustable such that the mattress 12 is moveable to alternate positions such as a reading position or other upright positions, which may be desirable for example for watching television or during times when the user wants to use the bed assembly 10 but not necessarily sleep.

The foundation 14 may comprise a plurality of legs 16 on which at least one frame or base 18 is positioned. The legs 16 may each be a single structure or may be formed of a plurality of structures which may allow for variation of the height of the foundation 14 and the overall bed assembly 10. The frame 18 may be defined by a plurality of surrounding members 19 and one or more support members 21 (FIG. 6) extending between the surrounding members 19. Additionally, a deck 24 (FIG. 2) may be disposed upon the frame 18. The deck 24 provides a support surface for the mattress 12 which is positioned upon the deck 24, as depicted. The deck 24 may be fixed or may have fixed and movable portions to allow adjustment of the mattress position. These portions may be seen in FIG. 6

The mattress 12 is defined by a plurality of layers 13 of foam. The foam layers 13 will be described further herein but allow for movement of ventilation air from an air mover disposed on the frame 18 or deck 24. The ventilation air moves from an air mover, such as a fan or pump, which is positioned on the frame 18. The air mover may be at a fixed location, or may move with the foundation, and directs air upwardly through the foam layers 13 and by way of multiple apertures which allow flow communication through the mattress 12. Accordingly, ventilation air is provided to an upper surface of the mattress 12 and it allows for the ventilation to inhibit heat buildup and undesired humidity which provides for better sleep for the user Referring now to FIG. 2, an exploded perspective view of the bed assembly 10 of FIG. 1 is depicted. The mattress 12 is exploded from the foundation 14 comprising the frame 18 and deck 24 to depict the upper surface of the deck 24. Additionally, two fan assemblies 34 are shown exploded from beneath the frame 18. The bed assembly 10 includes a head end 26 of the bed, which is generally at the right-hand side of the figure, and a foot end 28, which is generally at the left-hand side of the depicted figure. The head end 26 and foot end 28 generally define a longitudinal direction $L_O$ therebetween for the bed assembly 10 and which is referenced merely for ease of description, but is not limiting. In a perpendicular direction of the longitudinal direction $L_o$ of the bed assembly 10 is lateral direction $L_A$ which extends between the sides of the mattress 12. The longitudinal and latitudinal directions are generally depicted by lines marked $L_o$ and $L_A$. Again, these directions are merely provided for ease of description in referencing directions throughout this disclosure but should not be considered limiting.

Extending from the deck 24 is a mattress retainer 30. The retainer 30 is shown extending from the upper surface of the deck 24 near the foot end 28 of the bed assembly 10. This may be desirable when the deck 24 and mattress 12 are intended to be adjusted and therefore prevent the mattress 12 from sliding off from the deck 24. The mattress retainer 30 is shown at the foot end 28 and generally centered on the deck 24, but may alternatively be located in other positions.

The deck 24 is also shown with first and second conduit apertures 32 located therein. The conduit apertures 32 allow for passage of the conduit 74 upwardly through the upper surface of the deck 24 providing for ventilation air to move from beneath the deck 24 up through the deck 24 and also allow for flow communication with the mattress 12. The conduit 74 may be flexible where the deck is not moveable or alternatively may be flexible where the deck includes a movable portion. In some embodiments, the conduit may be defined by a combination of rigid and flexible portions.

Figure 3:
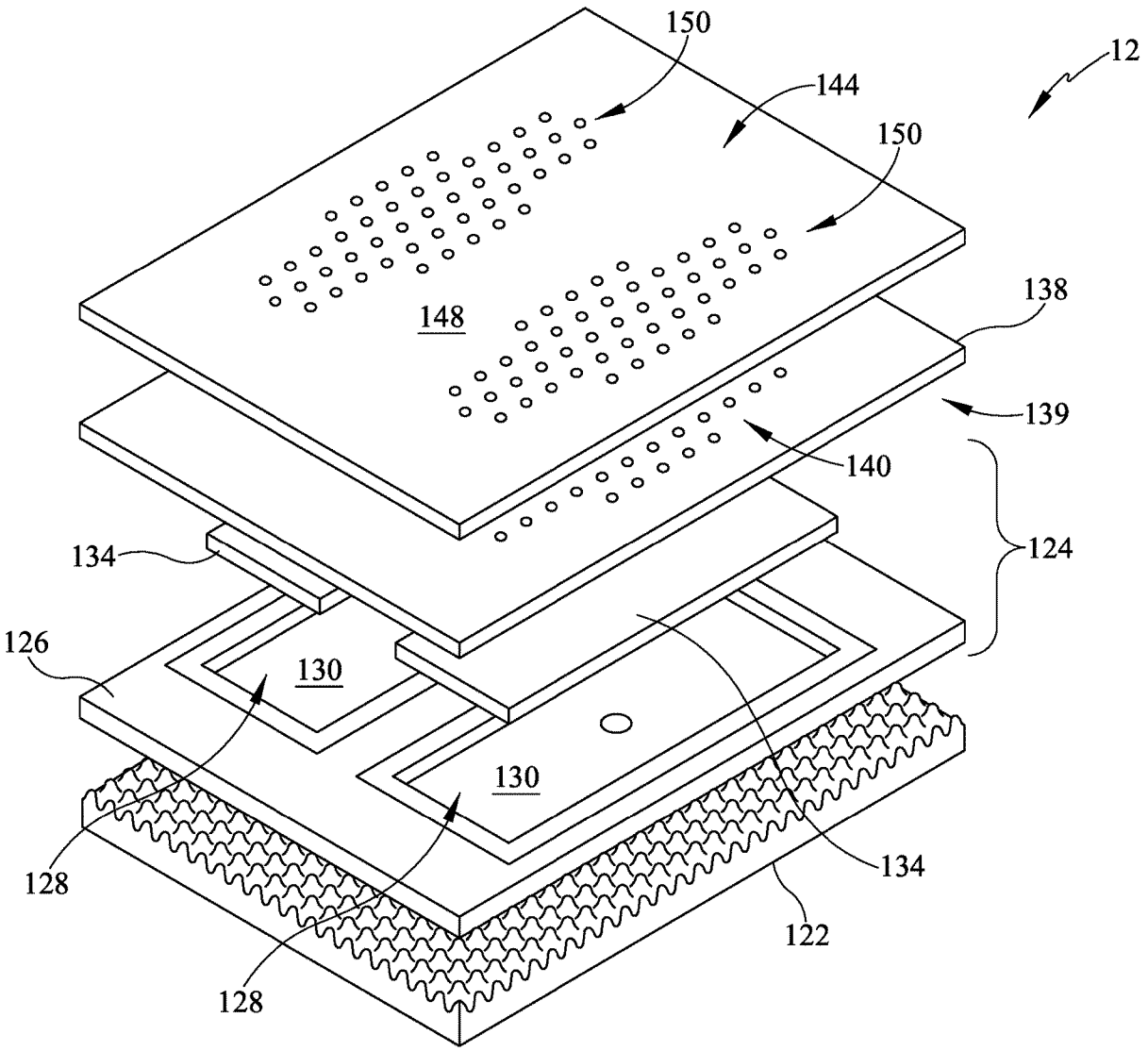
FIG. 3 is an exploded perspective view of the mattress.

Referring now to FIG. 3, the mattress 12 is shown in an exploded perspective view to depict the various layers of foam and material used to provide for ventilation. Starting at the bottom of the layers, a lower support layer is provided and may be formed of a convoluted foam 122 is depicted. The convoluted foam 122 may also be referred to as egg crate foam and provides a foundation for the remainder of the mattress layers.

The convoluted foam 122 may be a bottom hymax layer. The convoluted foam 122 provides a non-planar upper surface which may be defined by a plurality of curved or angular shapes. The term "foam" means a material in a lightweight cellular form, for example resulting from introduction of gas bubbles during manufacture to produce a consistent cell structure, and/or any of various light, porous, semirigid or spongy materials or cellular solids, usually the solidified form of a liquid full of gas bubbles, which may be used as a building material or for shock absorption, and includes open cell foams such as polyurethane foam, latex, memory foam, specialty memory foam, gel memory foam, gel latex foam, gel infused foam, a multi-gel foam, a high thermal conductivity foam, or other gel foams, etc. A component core layer may be any mattress core construction including, but not limited to, a foam core, a gel foam core, a latex core, an inner spring layer, a layer of individually wrapped or encased coils, an inflated air system, or a liquid system, e.g., water. According to some embodiments, the convoluted foam 122 may be an open-celled non-reticulated visco-elastic foam. In some embodiments it is desirable that the convoluted foam 122 of reticulated non-visco-elastic foam be capable of providing some degree of support that is substantially independent of temperatures experienced by the upper layers when supporting a user's body (i.e., independent of a user's body heat). Therefore, the convoluted foam 122 can comprise reticulated non-visco-elastic foam that is substantially insensitive to temperature changes within a range of between about 10° C. and about 35° C. As used herein, a material is "substantially insensitive" to temperature changes if the material exhibits a change in hardness of less than 10% measured by ISO Standard 3386 through the range of temperatures between 10 and 30 degrees Celsius. Other temperature ranges are also capable of use and therefore the temperature range should only be considered illustrative and not limiting. In some embodiments, the bottom layer 112 has a density of no less than about 20 kg/m3 and no greater than about 80 kg/m3. In other embodiments, a bottom layer 112 having a density of at least about 25 kg/m3 and no greater than about 60 kg/m3 is utilized. In still other embodiments, a bottom layer 112 having a density of at least about 30 kg/m3 and no greater than about 40 kg/m3 is utilized.

Disposed above the convoluted foam layer 122, is an air distribution assembly 124. The air distribution assembly 124 comprises a flat foam layer 126 positioned on the convoluted foam 122 and comprises cavities 128. Again the foam layer 126 may be any of the types described previously. In some embodiments, the layer 126 may comprise of a cellular structure of flexible visco-elastic polyurethane foam in which the walls of the individual cells are substantially intact. In some embodiments, the bottom layer 122, if comprising reticulated foam, can reduce heat in the higher layers, due at least in part to the cellular structure of the foam of the bottom layer 112. The cavities 128 may include an envelope material 130 which precludes air flow which enters the cavity 128 from exiting in an unintended direction. Otherwise stated, the envelope material 130 defines a flow boundary in order to control air flow in the cavity 128 and direct the air flow in a desired direction. The envelope material 130 may be formed of heat pressed TPU. In some non-limiting embodiments, the envelope material may be a multilayer material of polyester, TPU, and polyester. More specifically, and without limitation, the multilayer may comprise a first layer of 75 gsm polyester knitted fabric, a second layer of TPU and a third layer of polyester knitted fabric. These layers may be bonded together in a variety of non-limiting manners including but not limited to melting, welding, sewing, adhesive bonding or other forms or combinations of any of these. However, these bonding methods are not to be considered limiting. The illustrative, non-limiting poly knitted envelope material 130 may be available commercially from Standard Fiber, LLC of Burlingame, Calif.

Disposed above the cavities 128, the air distribution assembly 124 further comprises an air distribution material 134. The air distribution material 134 is positioned in the cavities 128 upon assembly and may be a reticulated foam or other porous material which allows air flow to move through the material 134 within the cavity 128, generally move horizontally and upwardly, from within the cavity 128 to the foam layers above. The air distribution material 134 allows the air flow to spread within the cavity 128 and is bounded by the envelope material 130, which prevents the air flow from moving beyond the cavity area and outwardly, for example horizontally, through the flat foam layer 126.

Disposed above the air distribution material 134 and on top of the flat foam layer 126, the air distribution assembly 124 further comprises at least one layer which may be a foam envelope layer 138 in some embodiments. The foam envelope layer 138 comprises a foam material, including any of the previously described examples, and along the lower surface may optionally include an additional envelope material 139. In some embodiments, the foam envelope layer 138 may comprise a cellular structure of flexible visco-elastic polyurethane foam in which the walls of the individual cells are substantially intact. In some optional embodiments, the envelope material 139 on the bottom of foam 138 limits flow of air from the air distribution material 134 to specific directions. The additional envelope material 139 may be formed of heat pressed TPU and/or as previously described a multilayer pressed material. This material 139 may for example be the same as that described poly knitted fabric or envelope material 130. In some embodiments, the foam envelope layer 138 may have density which is of a value that is high enough to limit or restrict air flow effectively without requiring the additional envelope material 139. In either arrangement, the airflow is limited to directions which are desired, such as the following manner. The foam envelope layer 138 may include a plurality of air flow apertures 140, which extend through the foam envelope layer 138 and through the optional envelope material 139, if used, on the bottom surface thereof so as to be in flow communication with the air distribution material 134. As one skilled in the art will understand, when the foam envelope layer 138 is positioned over the flat layer 126 with the air distribution material 134 therebetween, air moves upwardly through the flat layer 126 and spreads in the cavity 128 through the air distribution material 134. Air continues upwardly through the holes of the optional envelope material 139 and is limited in flow direction moving through the apertures 140 in the foam envelope layer 138. The apertures 140 may be all of a single size or may vary in diameter. Also, the density of holes 140 may vary depending on the area of the mattress where a user may be positioned.

Disposed above the foam envelope layer 138 is a body support foam layer 144. The body support foam layer 144 may also be defined by the foam envelope layer 138 or by a separate distinct foam layer as shown. The body support layer 144 includes a plurality of apertures 150 which are aligned with the 140 of the layer 138. The body support layer 144 or a combination of the layer 144 and the foam envelope layer 138 may define a comfort layer. This allows for movement of air upwardly through the two layers to the top surface 148 of the body support layer 144. The plurality of apertures 150 are shown varying in density. This means that there may be more holes per unit surface area in some places versus other places. In the provided example, the number apertures 150 increases in the area of the torso but may decrease in the area of the user's head and feet. Other variations or spacings may be utilized and for example, the density of apertures 150 may be consistent. Further, one skilled in the art will realize that where two layers of foam are positioned above the air distribution material, the apertures 150 will extend through both layers of foam, for example layers 138, 144. Further, the aperture 150 sizes may vary or may be the same as previously described. The apertures 150 may be sized based upon any of, but not limited to, the following: the desired flow rate at the upper surface 148 (FIG. 2) of the mattress 12 and/or the amount of air pressure needed to pass through the apertures 140, 150 and/or the number of apertures provided, and/or air mover flow rates and pressure.

The body support foam layer 144 and the foam envelope layer 138 may be formed of relatively highly resilient flexible cellular foam. These foams may be the same type of foam or may be differing types of foams from the examples provided. Further the foams may have differing characteristics, such as flexibility or stiffness, and other characteristics. Either or both layers may be used in order to direct air flow and provide a desired feel for the user.

The layers may be affixed by any suitable means known in the art. Layers may be sprayed-on, injection molded, extruded, coextruded, laminated, and the like. In several embodiments, layers may be stapled, tacked, welded, laminated, mechanically affixed via friction or interference fit, adhered via an adhesive, a glue, a cement, or other material with adhesive properties, stitched, affixed via hook and loop fastener, a zipper, a Dennison-style tag, snaps, and/or other reversible means, and combinations thereof. For purposes of present embodiments, various layers may be joined with adhesives including glues, cements and other materials with adhesive properties. In another embodiments, a layer may further include an adhesive. In some embodiments, the adhesive may be located at interfaces between the layers. Adhesives that may be used in the present disclosure include any adherent materials or fasteners known in the art. Specific examples of adhesives include hot melt, water-based, and pressure-sensitive adhesives, fire-resistant adhesives, and mixtures thereof. Further, a layer and/or an adhesive may further include a silica, a metallic layer, a plastic, such as an acrylic, a modacrylic, a polyolefin, a latex, a polyurethane, and combinations and/or blends thereof. In addition, a layer may further include biocides, preservatives, odor blocking agents, scents, pigments, dyes, stain guards, antistatic agents, anti-soiling agents, water-proofing agents, moisture wicking agents, and the like, as are known in the art.

Figure 4:
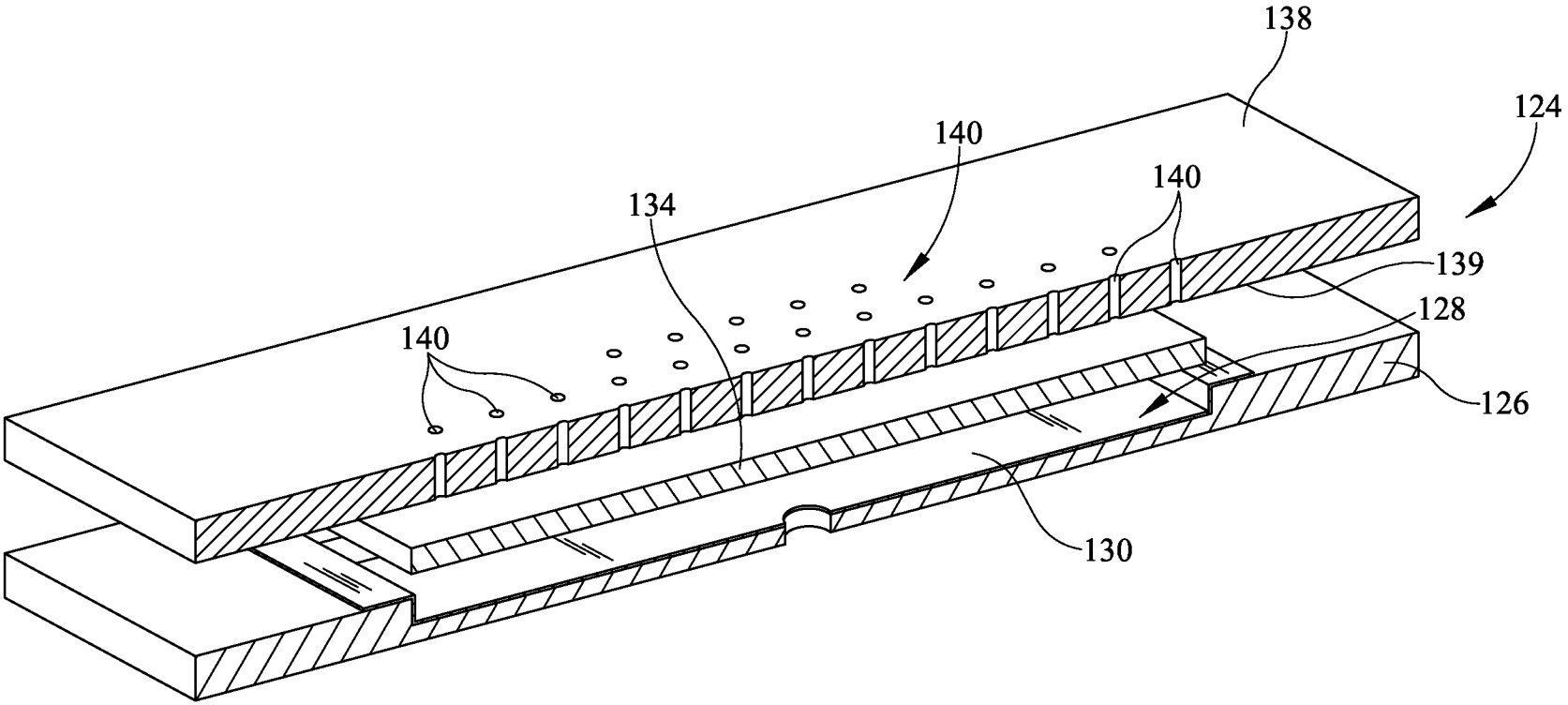
FIG. 4 is an exploded section detail view of the air distribution assembly.

Referring now to FIG. 4, an exploded section detailed view of the air distribution assembly 124 is depicted away from the other layers of the mattress 12. The section view more clearly depicts the arrangement of parts in a semi-assembled state. The air distribution material 134 is exploded from the cavity 128 of the flat foam layer 126. Within this flat foam layer 126, the cavity 128 allows for positioning of the reticulated foam, for example that may define the air distribution material 134, according to some examples. The envelope material 130 is also depicted which limits the air flow from moving in any direction except through the air distribution material 134. As the air flow moves through the air distribution material 134, the air flow moves horizontally between the head and feet ends 26, 28 of the mattress 12, moves laterally and moves upwardly toward the foam envelope layer 138 which may or may not include an envelope material 139. Once pressure builds in the cavity 128, the air may also move through the apertures 140 and subsequently to the aligned apertures 150.

Air flow may be limited and directed through the layer 138 by placing the envelope material 139 along a bottom surface thereof and allowing the apertures 140 to extend through the foam envelope layer 138 and through the envelope material 139. With air flow limited by the envelope material 139 and the envelope material 130 within the cavity 128, the only pathway for the air flow is through the plurality of apertures 140 of the foam envelop layer 138. The apertures are aligned with apertures 150 (FIG. 5) on the body support layer 144.

Figure 5:
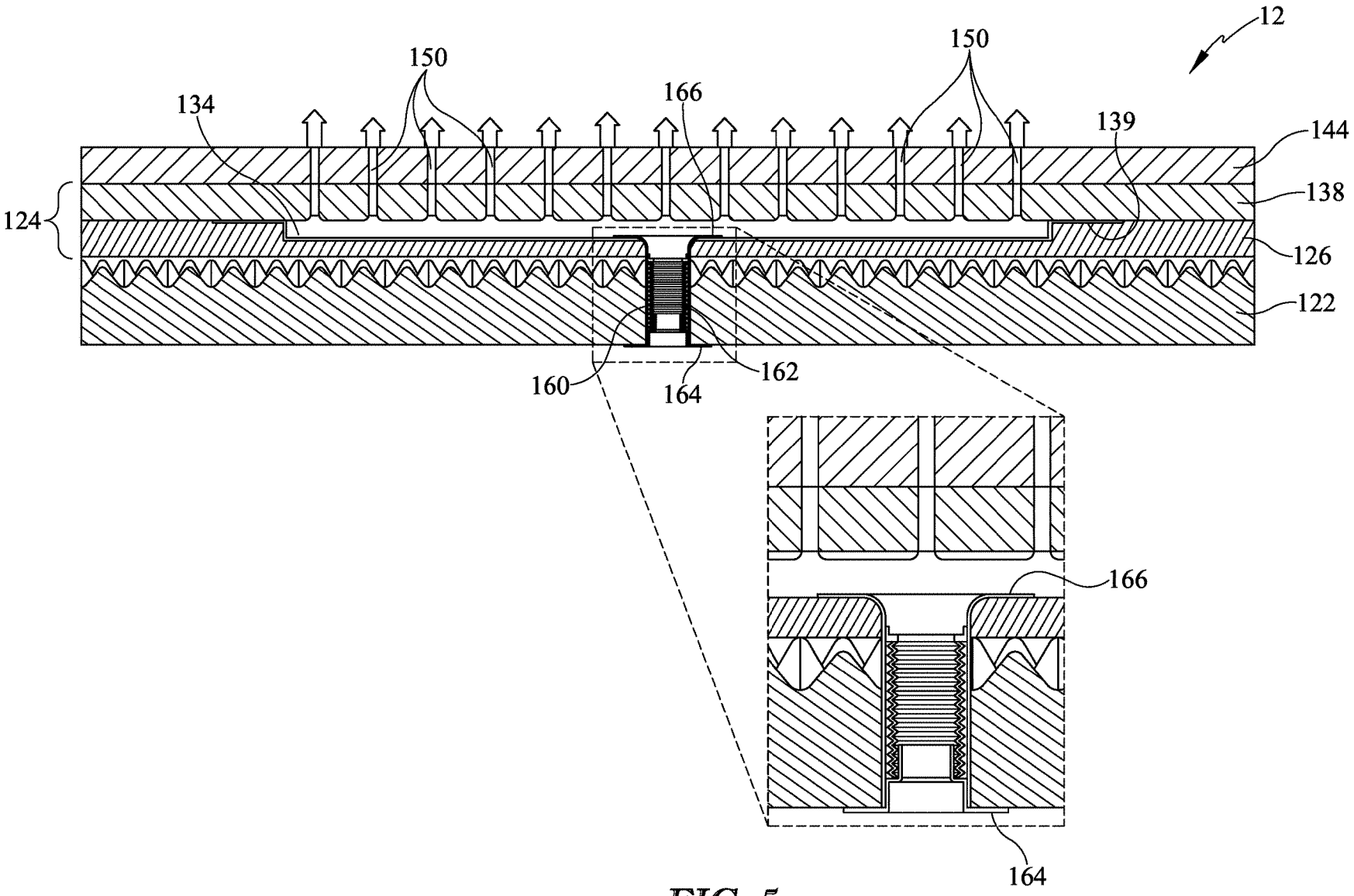
FIG. 5 is a section view of the mattress.

Referring now to FIG. 5, a section view of the mattress 12 is depicted to further aid in describing the ventilation air flow through the mattress 12. The mattress 12 includes the previously described layers of convoluted foam 122 and the air distribution assembly 124 comprising the flat foam layer 126 and the foam envelope layer 138 and the body support layer 144 above the air distribution assembly 124. As shown in the section view, a conduit aperture 160 is formed in the convoluted foam layer 122. The conduit aperture 160 extends through the convoluted foam layer 122 and into the air distribution assembly 124 so that air moving through a conduit 162. The aperture 160 extends into the flat foam layer 126 to provide flow communication to the air distribution material 134 of the air distribution assembly 124. As depicted in the drawing, the layers 138 and 144 have a plurality of aligned air flow apertures 140, 150 which are in flow communication with the air distribution material 134, which according to some embodiments may be a reticulated foam with the apertures 150 through the top two layers aligned and in flow communication, air moves to the top surface 148 of the body support layer to provide air flow around the user. The apertures 140, 150 are shown in a substantially vertical orientation but may be disposed at an angle relative to a vertical direction as well.

The conduit 162 may include a flexible material such as a corrugated tubing to allow for some bending, for example due to the mattress 12 being adjustable in some embodiments. However, the conduit should exhibit enough strength to not crush inwardly when the surrounding foam flexes during movement of the mattress and foundation. The conduit 162 may also comprise at least one flange 164, 166 at a lower end and an upper end of the air distribution assembly 124. The flanges 164, 166 may function to retain the conduit 162 in position within the foam. The flanges may also provide for a specific location for connection of the fan assembly 34 (FIG. 2) at the lower end. The flanges 164, 166 may capture the conduit 162 within the one or more layers of the mattress 12. According to the instant application, the mattress 12 may comprise one or more of these conduit assemblies so as to provide air flow to one or more areas of the mattress 12. For example, and with reference to FIG. 1, two areas of the mattress 12 may be serviced with ventilation air by using two fan assemblies 34 and two conduits 74 such shown in FIG. 2 which are in flow communication with conduits 160.

Figure 6:
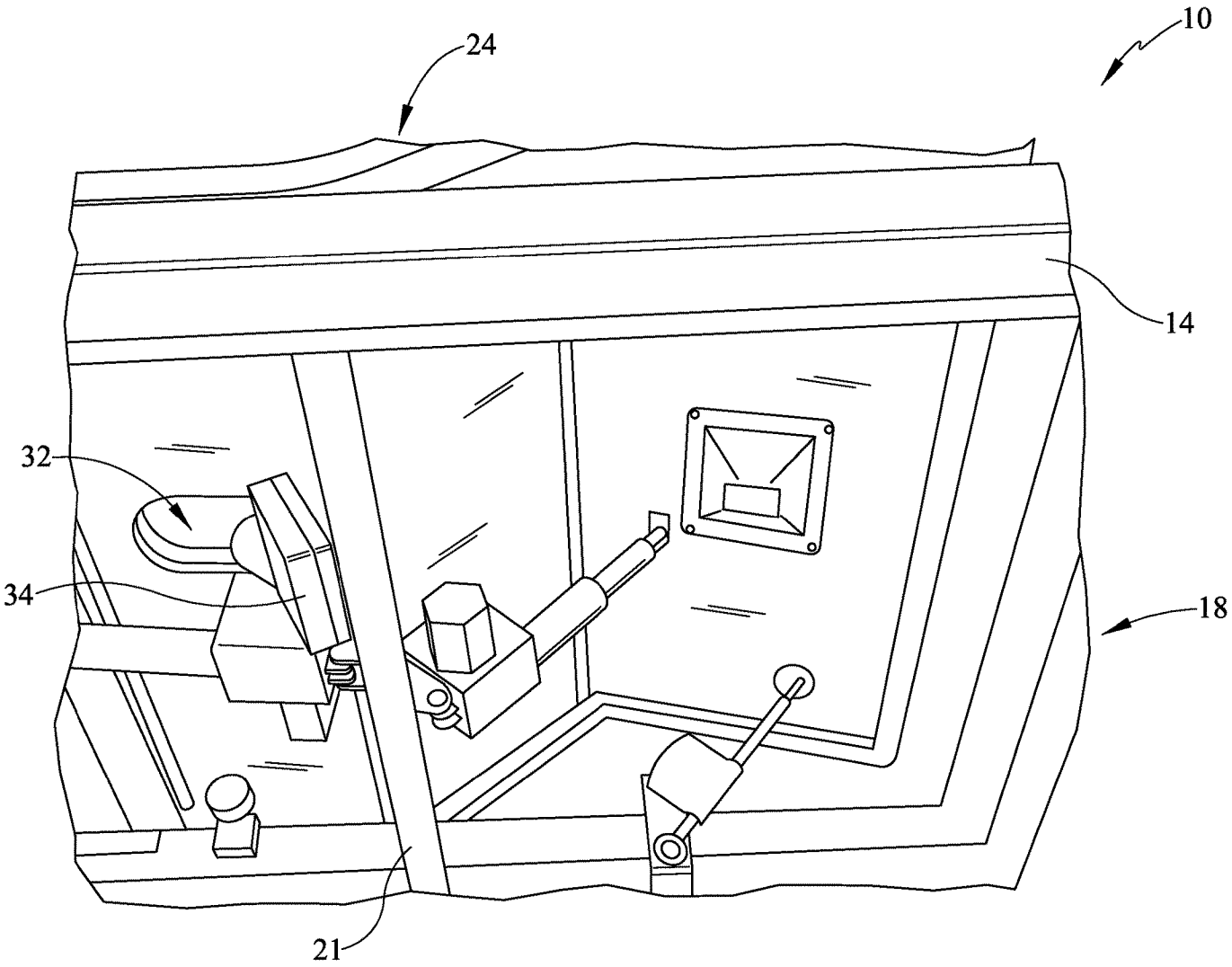
FIG. 6 is a lower perspective view of an air mover on the foundation.

Referring now to FIG. 6, a lower perspective view of the foundation 14 is shown. Various support members 21 are depicted extending between the outer members of the frame 18 of the bed assembly 10. The lower perspective view is provided to depict the mounting of the air mover on the frame 18. The conduit aperture 32 is also shown disposed through the deck 24 so that when the conduit is connected to the fan assembly 34, the conduit 74 may pass through the deck 24 and to the mattress 12 above (now shown). The outer frame members may also include a fabric and/or padding to improve the appearance of the foundation 14. The frame 18 is fixed and the deck 24 is shown with fixed and movable portions wherein the movable portion moves relative to the frame 18 to adjust the mattress position or orientation. The fan assembly 34 is shown below the fixed deck portion according to some non-limiting embodiments.

Figure 7:
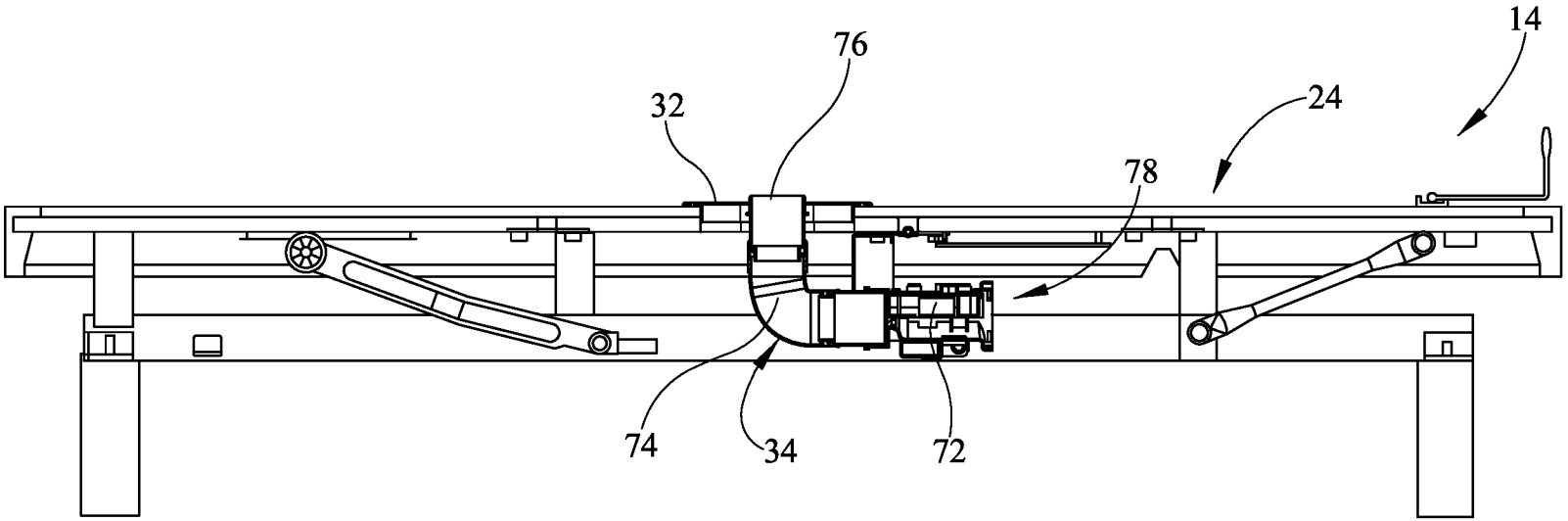
FIG. 7 is a side view of the air mover on the foundation.

Referring now to FIG. 7, a side view of the foundation 14 is depicted with the fan assembly 34 shown through the deck 24. The fan assembly 34 includes an air mover 72 and a connector 76 which is shown extending through the deck aperture 32. The deck aperture 32 may be a hole and/or additionally may be defined by a collar which provides a clean opening through the upper surface of the deck 24. The air mover 72 may comprise an inlet, at the right hand side as depicted and an outlet at the left hand side, wherein the air is drawn into the inlet, accelerated and pushed though the outlet. These positions may vary. The air mover 72 may also comprise a filter housing or other air cleaning structure to remove certain contaminants from the air flow passing through the fan assembly 34. The air filter housing may be disposed at the inlet of the air mover 72 to provide filtered air to the outlet and conduit 74.

Figure 8:
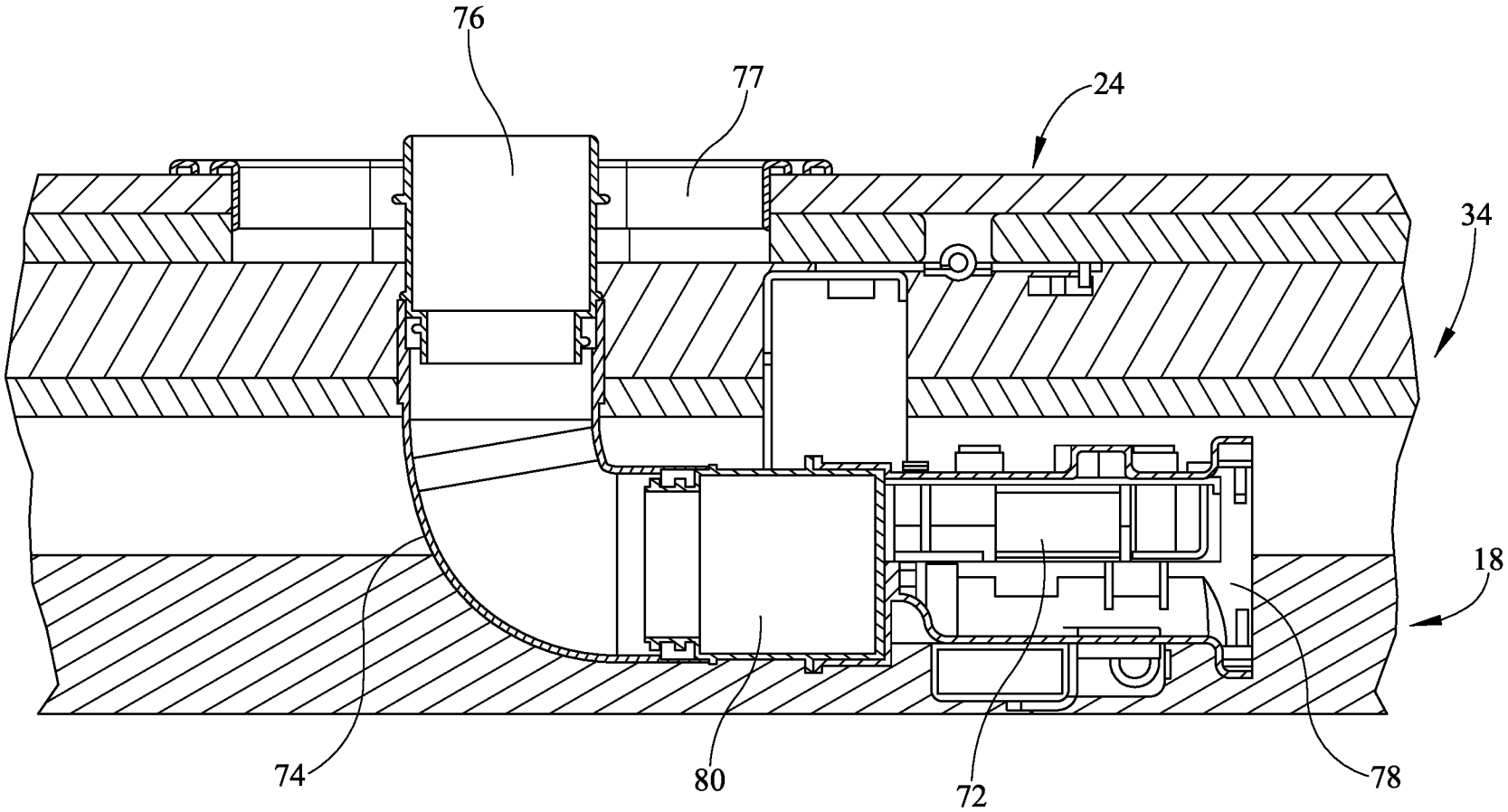
FIG. 8 is a detailed side section view of a fan assembly.

With reference to FIG. 8, a detailed side section view of the fan assembly 34 is depicted. The air mover 72 is shown adjacent to an air filter housing 78. The air filter housing 78 defines an opening wherein ventilation air is pulled through the filter 78 and into the air mover 72. On the left side of the air mover 72, is a connector 80. On the left side of the air mover 72 is an air mover outlet connector 80 which is connected and provides flow communication with the flexible conduit 74. The flexible conduit 74 may be a corrugated material that allows for bending thereof at a 90 degree turn. The flexible conduit 74 turns from a horizontal flow path to a vertical flow path and is connected additionally to the connector 76, which is shown passing through a collar 77 in the deck 24. The upper connector 76 is additionally then connected to the lower flange 164 (FIG. 5) of the conduit assembly extending through the mattress 12. This allows for air flow pulled in through the air intake and optional air filter 78 through the air mover 72 and through the flexible conduit to the mattress 12. Within the mattress 12, the air is dispersed through the air distribution assembly 124 and specifically the air distribution material 134 before passage through the foam layers 138, 144 above the air distribution material 134 (FIG. 3).

Still further, aroma-therapy cartridges and/or filters may also be utilized. For example, in nonlimiting embodiments, aroma may be added to a filter material in order to provide a pleasing aroma to the filtered air. The filter may be disposed in the assembly containing the fan, pump, or the like, or may be disposed in the ducting extending toward or into the mattress. It may be desirable to ensure that the filter and aroma cartridge may be easily accessible for maintenance or exchange. The cartridge may be disposed on the suction (upstream) side of the air mover, or may be disposed on the pressurized (downstream) side. The filter may be of various ranges of filtering capability and may remove pollen, particulate and/or dust mites and related materials.

Figure 9:
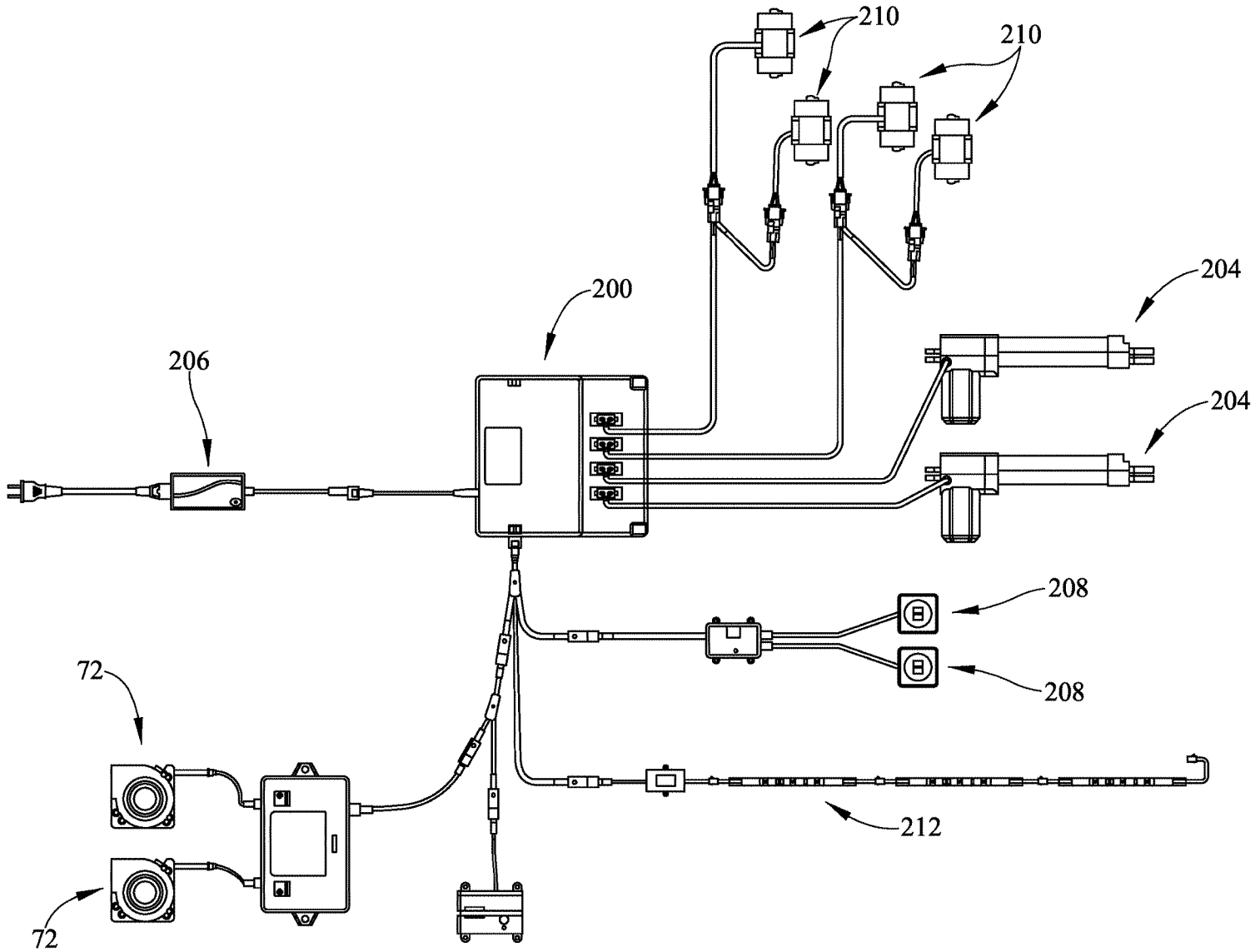
FIG. 9 is a schematic view of the system utilized to ventilate the bed assembly; and, FIG. 10 is an exploded view a mattress cover according to some embodiments.

Referring now to FIG. 9, a schematic view of the system utilized to ventilate the bed assembly 10 is shown. In the schematic view, a controller 200 is depicted which is shown in wired connection to various other service facilities for the adjustable bed 10. The controller 200 is connected to the air movers 72 to provide power and control signals to the air movers 72. Additionally, the controller 200 may be in communication with actuators 204 for movement of the deck 24 (FIG. 7) to positions in order to raise the head end of the bed or the feet end of the bed. Additionally, or alternatively, the actuators 204 may be used for movement of the foot portion of the bed. Still further, two actuators 204 may be utilized as shown to move both head and foot ends of the bed assembly 10. A power supply 206 is shown electrically connected to the controller 200. The power supply 206 may be an AC power supply which converts power to DC, according to some embodiments, for powering of the DC fans of the air movers 72 or the actuators 204.

Additionally, the controller 200 may provide for one or more USB chargers 208 so that a smart phone, smart pad or other electrical devices may be charged while the user is sleeping or alternatively while the user is in bed and may be, for example reading or listening to music.

Optionally, the bed assembly may also include vibrator motors 210 which are in electrical communication with the controller 200. The vibration motors 210 may provide a massaging function for the bed assembly 10. The vibrating motors 210 may be disposed on two sides of the bed, relative to the longitudinal axis $L_O$ (FIG. 2), according to some embodiments. Further, the vibrating motors 210 may work together or may be controlled individually. While two motors 210 are depicted, the bed assembly may be broken up into additional zones wherein at least one vibrating motor may be provided for each zone. The vibrating motors 210 may be controlled in a simple manner of on/off functionality or additionally may be varied in speed to provide varying amounts of vibration and massage function.

Optional features such as under bed lighting 212 may be provided and powered for use. Numerous optional features may be provided and the descriptions provided herein should not be considered exhaustive.

The controller 200 may be controlled by a wired remote control or a wireless remote control. The wireless remote may be connected by radio frequency (RF), infrared, Wi-Fi, Bluetooth, zigbee or other wireless communication standards. The remote may be a standalone remote control with hard keys or buttons, touch screen or some combination. Further, the wireless remote controller may be defined by smart phone or smart pad with an app which connects by some communication standard to the controller 200. Accordingly, the controller 200 may have some feature The controller 200 may also have a battery backup system. The battery back-up may be charged by an electrical connection which powers the controller 200. The battery back-up may also provide that the system may be controlled for at least some period of time while power service may be unavailable.

Figure 10:
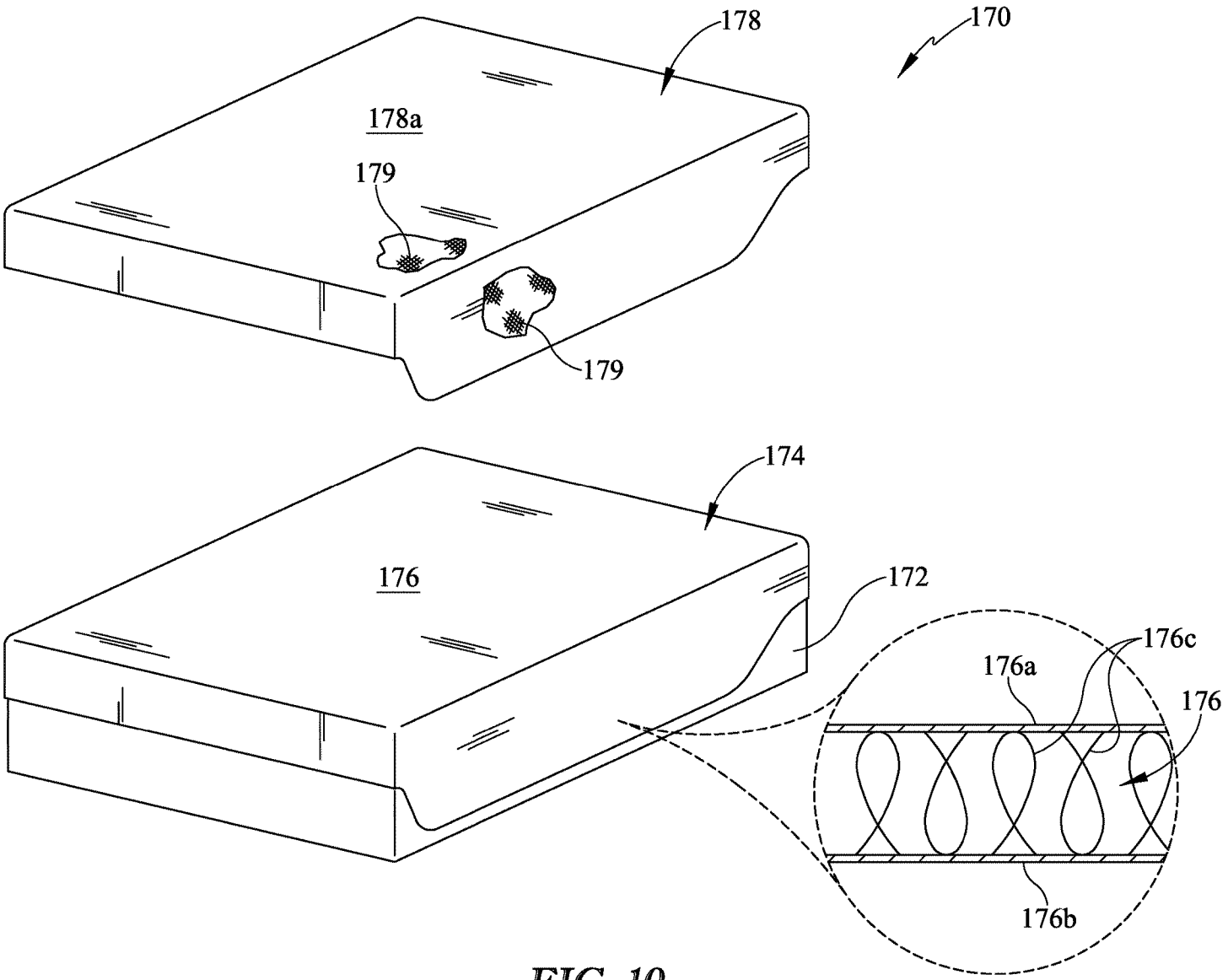

Referring now to FIG. 10, an exploded perspective view of a mattress cover 170 which allows for passage of air flow from the mattress. It is desirable to not impede, or at least limit impedance, of air flow from the mattress upper surface. The instant mattress cover 170 embodiments limit the plugging of holes in the mattress so that air can continue to flow providing a ventilating function from the mattress.

The cover 170 comprises a border 172 and an inner panel 174 which is formed of a bi-directional stretch spacer fabric 176. The spacer fabric 176 may be formed of a bi-directionally stretched material, meaning it is stretchable in two dimensions, such as the horizontal directions, for example head to toe and laterally, side to side relative a bed. The spacer fabric 176 may be formed of an upper layer 176*a* and a lower layer 176*b* as shown in the detail view. Further, the fabric 176 is also formed with a three-dimensional cross-structure between the layers 176*a*, 176*b* which provides a volume or air space through which air can flow. The third dimension (vertically as depicted) is of limited stretch capability as compared to the horizontal directions.

The spacer fabric 176 may include a woven, or knit material, and/or may include extruded plastic materials including polyethylene, polyester, other plastics or combinations of any of these or others. According to some embodiments one of the layers 176*a*, 176*b* may be formed of polyester, and spandex. In some embodiments these materials may be formed of the same or differing thread sizes and in other embodiments multiple sizes of one or more materials may be utilized. For example, in the illustrative, non-limiting embodiment, the layer may contain 150 Denier polyester with 40 Denier and 70 Denier spandex. The other of the layers 176*a*, 176*b* may be 150 Denier polyester and a 40 Denier spandex. The three-dimensional cross structure shown extending between layers 176*a*, 176*b* may be a 30 Denier polyester, for non-limiting example. The pattern may be random or may be repeating or some combination of fibers. Additionally, the spacer fabric 176 is resilient to allow a repeated uses without degradation and losing its thickness dimension. Thus, the material maintain the volume between the layers 176*a*, 176*b* to allow adequate airflow therethrough. One non-limiting example of this spacer fabric 176 is commercially marketed by Global Textile Alliance of China.

According to one non-limiting example, the spacer fabric may be comprised as follows:

| Yarn Location | Fiber Type | Yarn Size | % Fabric Content |
|---|---|---|---|
| Layer 176a | Polyester | 150D/48F/1 | 20-30 |
| Layer 176a | Spandex | 40D | 2-12 |
| Layer 176a | Spandex | 70D | 6-16 |
| Layer 176c | Polyester | 30D | 13-28 |
| Layer 176b | Polyester | 150D/48F/1 | 20-35 |
| Laver 176b | Spandex | 40D | 2-12 |

The spacer fabric 176 precludes blockage of the holes in the upper surface of the body support cushion, thereby facilitating ventilation. Thus a breathable surface is provided and air flow is not impeded when a user lays on the mattress. The stretch spacer fabric 176 improves cooling performance for the air flow, reduction of relative humidity and improved dry thermal resistance. Additionally, the spacer fabric 176 may reduce pressure on the user.

Still further, the spacer fabric 176 may be treated with or finished with various agents and/or topical treatments including but not limited to wetting agents, pH buffers and antimicrobial agents. Further the spacer fabric may have a desirable finished appearance by way of desired color or pattern(s) formed by the knitting process.

The border 172 and the inner panel 174 may be formed together as a single part. In some embodiments, the border and inner panel 174 may have a fastener or closure, for example a zipper arrangement, to allow for placement of the mattress within the border 172 and inner panel 174. A second fastener or closure may be used to attach a top panel 176.

It is desirable to reduce the dry thermal resistance of the mattress cover 170. This allows air pushed through the mattress to exit the cover 170 more readily, improving the function of the ventilation system, and performing less like an insulator.

Dry Thermal Resistance, $R_{ct}$

Calculated in SI units for each zone by the formula:

$$R_{ct} = \frac{(T_{skin} - T_{amb})}{Q/A}$$

$R_{ct}$ = Thermal Resistance $(m^2 \cdot {}^\circ\text{C.})/W$ $T_{skin}$ = Zone average temperature (° C.)

$T_{amb}$ = Ambient temperature (° C.)

$Q/A$ = Area weighted Heat $(W/m^2)$ where the R-value is a measure of how well an object, per unit of its exposed area, resists conductive flow of heat. The greater the R-value, the greater the resistance, and accordingly the better the thermal insulating properties of the object. R-values are used in describing effectiveness of insulation and in analysis of heat flow across assemblies (such as walls, roofs, windows or mattresses) under steady-state conditions. The lower the R-value, the better a material is at dissipating heat and conversely the higher the R-value, the more the material functions as an insulator.

Example I: Prior Art Cover

| | DTR [$m^2$C./W] |
|---|---|
| Prior Art Cover | 0.48 |
| Prior Art Cover and 3 mm spacer | 0.18 |
| Prior Art Cover and 6 mm spacer | 0.15 |

In this first example, a prior art cover was provided and dry thermal resistance was measured both without the spacer fabric 176 and with the spacer fabric. As shown in the results, there is a significant decrease in the dry thermal resistance when the spacer material is added to the prior art cover.

Example II: Cover

| | DTR [$m^2$C./W] |
|---|---|
| Cover | 0.46 |
| Cover and 3 mm spacer | 0.18 |
| Cover and 6 mm spacer | 0.16 |

In this second example, the instant cover materials were provided both without and with the spacer material. Comparing cover to cover, the cover of the second example has a lower dry thermal resistance than the prior art version of the first example. Further, as with the first example, addition of the space fabric 176 makes a significant change in the dry thermal resistance of the cover. Further, in both examples, the increase in thickness of the spacer fabric 176 improves the dry thermal resistance as well. This is due to the reduced blockage of holes in the mattress.

Disposed above the inner panel 174 is a top panel 178 which is formed of two materials. The upper portion of the top panel 178 is formed in some embodiments of an ultra-high molecular weight polyethylene (UHMWPE). The top panel 178 may also have an optional topical fire resistant chemistry. The fire resistant topical may be, according to some embodiments defined by, but is not limited, organic-inorganic nitrogen-phosphorous based topical chemistries. The fire resistant chemistry may alternatively include but is not limited to an encapsulated fire retardant treatment for example, made by using a melamine cyanurate encapsulating shell, using an alcohol C11 ethoxylated surfactant for dispersion, and using a Phosphate based fire retardant polymer.

Knitted on a lower surface of the top panel is a fire resistant (FR) modacrylic yarn layer 179. The FR yarn layer 179 is desirable in part because the introduction of air flow from the mattress requires improved fire resistance. The FR modacrylic yarn layer 179 provides improved fire resistance and is knit to the lower surface of the upper portion of the top panel 178. The fire resistant topical chemistry provides additional fire resistance in combination with the FR modacrylic yarn 179.

One or more of the layers of the cover 170 may also comprise phase change material to provide improved cool feeling for a limited time. The amount of phase change material in the one or more layers may be the same or may differ.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A bed with ventilation system, comprising: a foundation having at least a fixed base portion and at least a fixed deck portion; an air mover disposed on one of said fixed base portion or said fixed deck portion, said air mover having an inlet and an outlet to produce an air flow of ambient air;

a conduit in flow communication with said air mover outlet at a first end of said conduit, a second end of said conduit in flow communication with a mattress;

said mattress having:

a lower support layer formed of convoluted foam;

an air distribution assembly disposed above said lower support layer, said air distribution assembly including a cavity formed in a flat foam layer and a multi-layer envelope material disposed within said cavity and at least partially on an upper surface of said flat foam layer, said multi-layer envelope material precluding said air flow of said ambient air and defining a flow boundary within said cavity;

a reticulated foam disposed in said cavity;

a foam envelope layer having a first plurality of air flow apertures, said foam envelope layer disposed over said cavity and said reticulated foam, said foam envelope layer having a second envelope material disposed on a bottom surface of said foam envelope layer without blocking said first plurality of air flow apertures of said foam envelope layer;

a body support foam layer disposed above said air distribution assembly, said body support foam layer having a second plurality of apertures;

wherein said reticulated foam receives said air flow of said ambient air from said conduit extending through said multi-layer envelope material and distributes said air flow of said ambient air to said first plurality of apertures of said foam envelope layer and from said first plurality of apertures to an upper surface of said body support foam layer through said second plurality of apertures in the body support foam layer, such that a majority of said air flow of said ambient air passes through said second plurality of apertures of said body support foam layer.

2. The bed of claim 1, wherein at least some of said first plurality of apertures are aligned with at least some of said second plurality of apertures.

3. The bed of claim 2, at least one of said first or second plurality of apertures varying in density between head and foot ends of said mattress.

4. The bed of claim 1, at least one of said first or second plurality of apertures being substantially vertical.

5. The bed of claim 1, at least one of said first or second plurality of apertures being angled relative to a vertical direction.

6. The bed of claim 1, said cavity being a first cavity and a second cavity.

7. The bed of claim 1, further comprising said second envelope material being a second multi-layer envelope material disposed above the cavity.

8. The bed of claim 1, said cavity being rectangular.

9. The bed of claim 1, said cavity having a conduit connection aperture.

10. The bed of claim 1, said cavity defining a boundary for air flow in said air distribution assembly.

11. The bed The body support cushion of claim 1, wherein said mattress is flexible and capable of moving with adjustment of a movable deck portion.

12. The bed The body support cushion of claim 1, wherein said conduit passes through said fixed deck portion.

13. The bed of claim 1 wherein the air flow of ambient air may be filtered and provide aroma therapy.

14. The bed of claim 1 further comprising a cover comprising a top panel and an inner panel having a spacer fabric.

15. The bed of claim 14 wherein said spacer fabric is disposed against said top panel.

16. The bed of claim 14, said spacer fabric being formed of a bi-directional stretch fabric having a three dimensional cross-structure.

17. The bed of claim 1 further comprising a cartridge which provides aroma therapy in flow communication with the air mover.

18. The bed of claim 1, further wherein said conduit is flexible.

* * * * *